US009325118B2

(12) United States Patent
Chang et al.

(10) Patent No.: US 9,325,118 B2
(45) Date of Patent: Apr. 26, 2016

(54) ELECTRICAL CONNECTOR HAVING CAPACITOR WITH LOW CROSS TALK

(71) Applicant: HON HAI PRECISION INDUSTRY CO., LTD., New Taipei (TW)

(72) Inventors: Yen-Chih Chang, New Taipei (TW); Tzu-Yao Hwang, New Taipei (TW); Ke-Hao Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 37 days.

(21) Appl. No.: 14/271,467

(22) Filed: May 7, 2014

(65) Prior Publication Data

US 2014/0335731 A1 Nov. 13, 2014

(30) Foreign Application Priority Data

May 7, 2013 (TW) ..... 102208410 U

(51) Int. Cl.

| | |
|---|---|
| ***H01R 13/66*** | (2006.01) |
| ***H01R 13/6466*** | (2011.01) |
| ***H01R 13/6588*** | (2011.01) |
| *H01R 12/71* | (2011.01) |

(52) U.S. Cl.

CPC ..... *H01R 13/6466* (2013.01); *H01R 13/6588* (2013.01); *H01R 12/716* (2013.01)

(58) Field of Classification Search

CPC . H01R 13/6464; H01R 23/688; H01R 23/722
USPC ..... 439/620.13, 620.15, 607.08, 66, 620.09
See application file for complete search history.

(56) References Cited

U.S. PATENT DOCUMENTS

| | | | | | |
|---|---|---|---|---|---|
| 4,726,790 | A * | 2/1988 | Hadjis | H01R 13/7195 | 333/185 |
| 4,772,225 | A * | 9/1988 | Ulery | H01R 13/7195 | 29/854 |
| 4,781,624 | A * | 11/1988 | Shepherd | H01R 13/7195 | 333/181 |
| 5,201,855 | A * | 4/1993 | Ikola | H01R 13/65802 | 439/607.14 |
| 5,580,279 | A * | 12/1996 | Belopolsky | H01R 13/6625 | 439/620.09 |
| 5,830,016 | A * | 11/1998 | Chuang | H01R 13/6666 | 439/620.09 |
| 6,086,422 | A * | 7/2000 | Glynn | H01R 13/719 | 439/620.07 |
| 7,001,197 | B2 | 2/2006 | Shirai et al. | | |
| 2013/0017721 | A1 | 1/2013 | Mason et al. | | |

* cited by examiner

*Primary Examiner* — Hae Moon Hyeon

(74) *Attorney, Agent, or Firm* — Wei Te Chung; Ming Chieh Chang

(57) ABSTRACT

An electrical connector includes an insulative housing having a plurality of walls formed a plurality of passageways thereof, a plurality of contacts received in the passageways, and a capacitor series connecting with the contact.

13 Claims, 5 Drawing Sheets

ELECTRICAL CONNECTOR HAVING CAPACITOR WITH LOW CROSS TALK

BACKGROUND OF THE INVENTION

1. Field of the Invention

The present invention relates to an electrical connector, and more particularly to an electrical connector having a capacitor in series connecting with contacts of the electrical connector for reducing cross talk.

2. Description of Related Art

US patent publication No. 20130017721 issued to Mason et al. on Jan. 17, 2013 discloses an electrical connector assembly including an interposer having a side surface and an array of electrical contacts exposed along the side surface. The electrical contacts are located within a contact region that extends along the side surface. The electrical contacts are configured to engage an electronic module mounted on the contact region. The connector assembly also includes a shield wall attached and extends along the side surface. The shield wall separates the contact region into shielded sub-regions. The shield wall includes a conductive material and is electrically coupled to an interposer. At least one electrical contact is located within the shielded sub-region. The shield wall extends between adjacent electrical contacts to shield the adjacent electrical contacts from electromagnetic interference. However, this type of electrical connector assembly still needs to reduce cross talk.

Therefore, an improved electrical connector is needed.

SUMMARY OF THE INVENTION

An object of the present invention is to provide an electrical connector having a capacitor in series connecting with contacts of the electrical connector for reducing cross talk.

According to one aspect of the present invention, an electrical connector comprises an insulative housing having a plurality of walls formed a plurality of passageways thereof; a plurality of contacts received in the passageways; and a capacitor series connecting with the contact.

According to another aspect of the present invention, an electrical connector mounted on a printed circuit board, comprises an insulative housing, a plurality of contacts, and a plurality of capacitors. The insulative housing has a plurality of walls formed a plurality of passageways thereof. The contacts are received in the passageways and include signal contacts and ground contacts. The capacitors are disposed on the printed circuit board. At least one capacitor in series connects with a signal contact on the transmission path.

Other objects, advantages and novel features of the invention will become more apparent from the following detailed description of a preferred embodiment when taken in conjunction with the accompanying drawings.

DETAILED DESCRIPTION OF THE INVENTION

Figure 1:
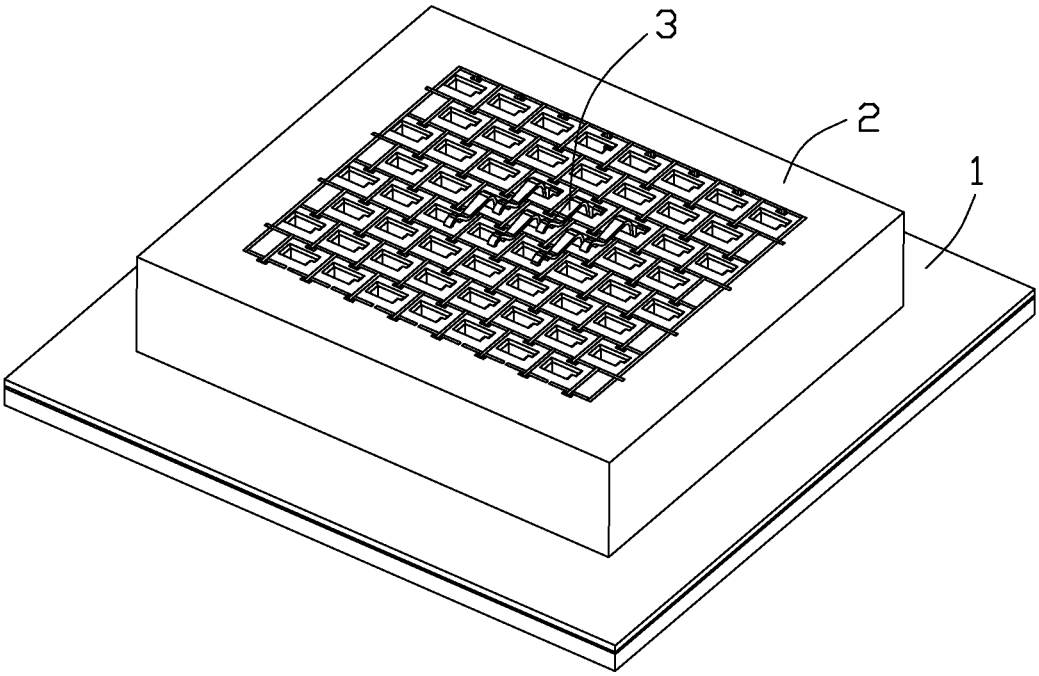
FIG. 1 is an assembled, perspective view of an electrical connector mounted to a printed circuit board in accordance with the present invention.
Figure 2:
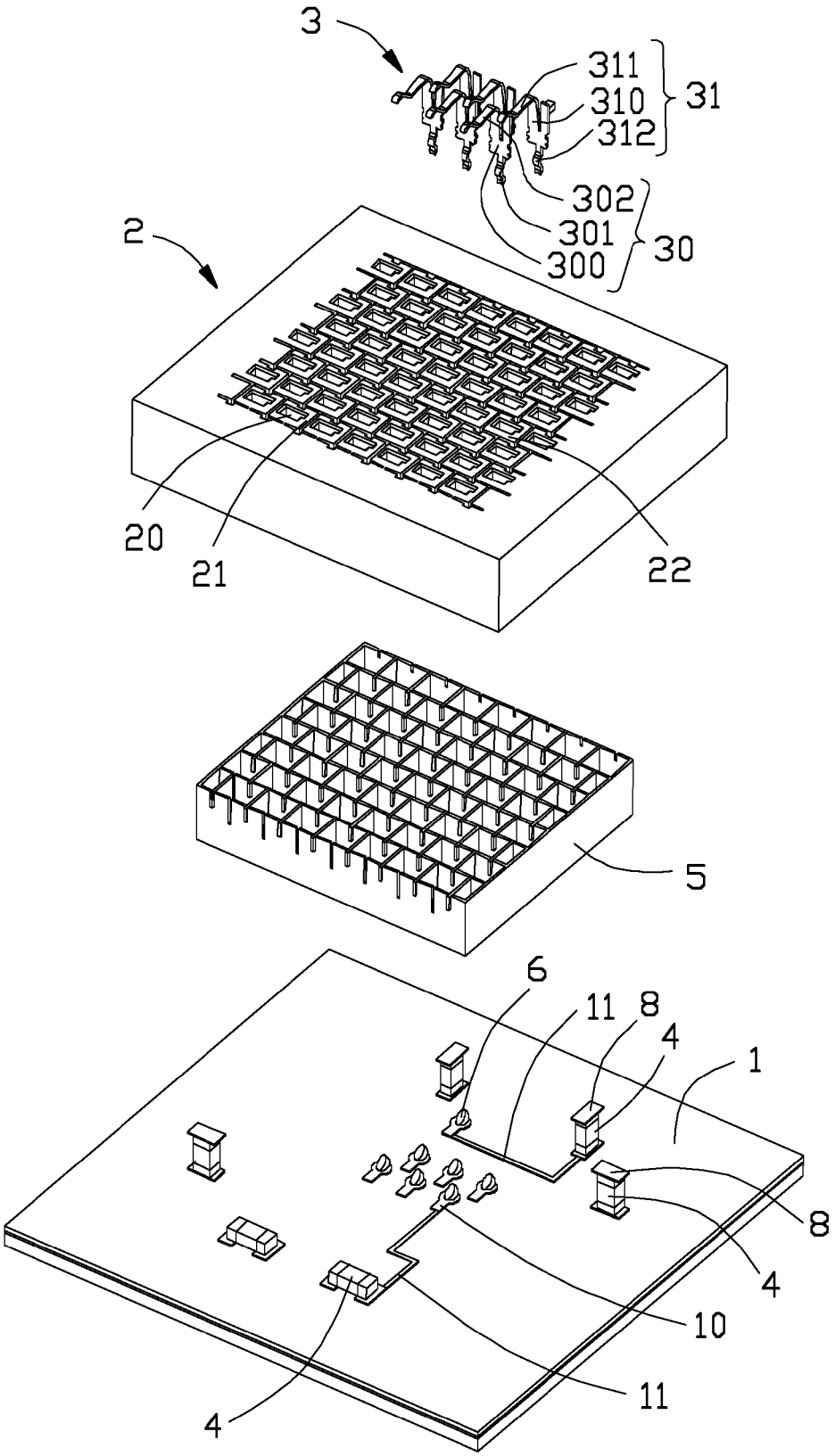
FIG. 2 is an exposed, perspective view of the electrical connector shown in FIG. 1.

Referring to FIGS. 1 to 2, an electrical connector used for electrically connecting an electronic package (not shown) and a printed circuit board 1, comprises an insulative housing 2, a plurality of contacts 3 (omitted partial contacts) received in the insulative housing 2, a plurality of capacitors 4 connecting with the contacts 3, and a shield frame 5, in a grid pattern, used to electromagnetic interference (EMI) that occurs during operation of the electrical connector with the electronic package. The contacts 3 include signal contacts 30 and ground contacts 31.

The insulative housing 2 has a substantially rectangular shape and includes a plurality of passageways 20 and a plurality of walls 21 forming the passageways 20. The shield frame 5 is located in the walls 21 and formed the passageways 20 with walls 21 commonly. The signal contacts 30 and the ground contacts 31 are received in the passageways 20 to form a receiving area 22. The capacitors 4 are disposed out of and around the receiving area 22. The capacitors 4 in this embodiment are divided into two groups. The first group capacitors 4 connect with the signal contacts 30 and the second group capacitors 4 connect with the shield frame 5.

Referring to FIG. 2 to FIG. 5, each signal contact 30 includes a receiving portion 300 received in the passageway 20, a tail portion 301 extending downwardly from the receiving portion 300, and a head portion 302 extending upwardly beyond the insulative housing 2. The head portions 302 are used for electrically connecting the electronic package and the tail portions 301 are soldered to pads 10 of the printed circuit board 1 by soldering balls 6. In this embodiment, a part of signal contacts 3 weld to the pads 10 and connect with the first group capacitors 4 via the lines 11 (only show one line). The first group capacitors 4 transmit the signal to other electrical elements (not shown). Since the capacitors 4 of the series circuit can filtrate the low frequency signal direct circuit, and remain the high frequency alternating circuit, therefore to reduce the cross talk of the signal terminals 30 and around there.

Figure 3:
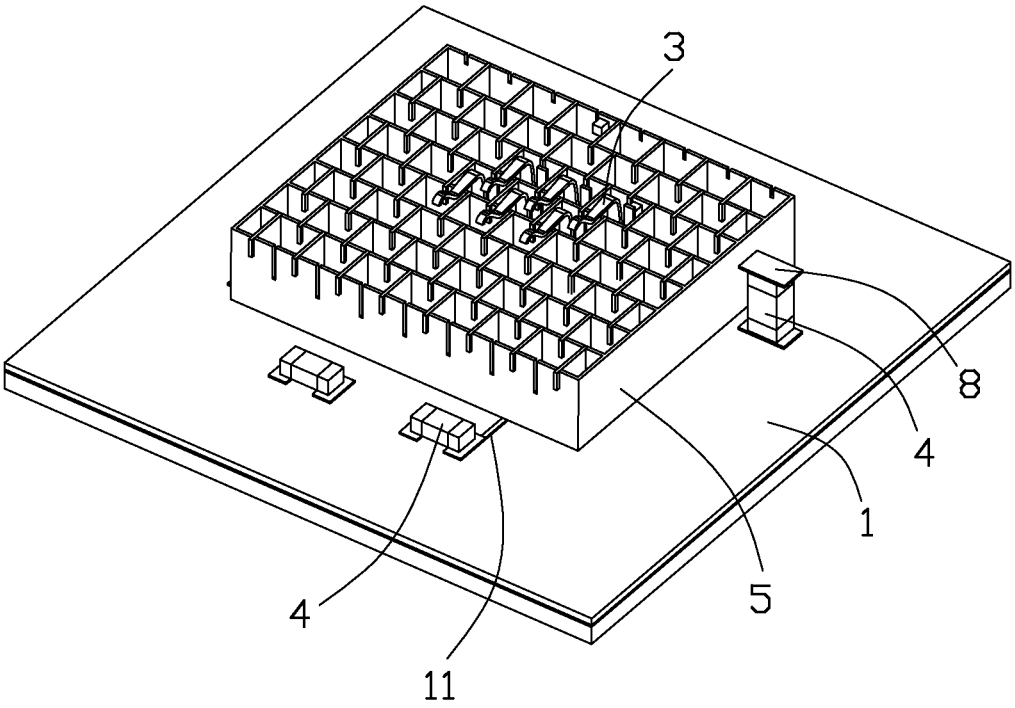
FIG. 3 is an assembled, perspective view of the electrical connector removed an insulative housing.
Figure 4:
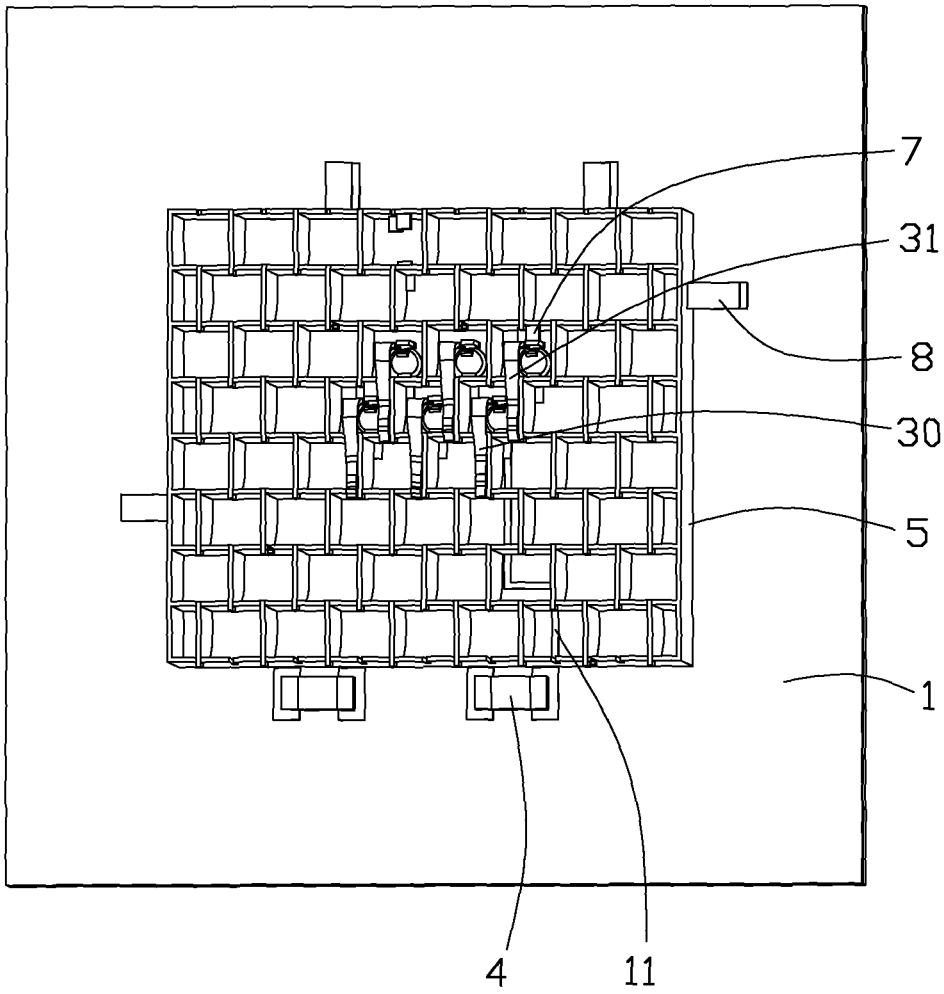
FIG. 4 is another side view of the electrical connector shown in FIG. 3.
Figure 5:
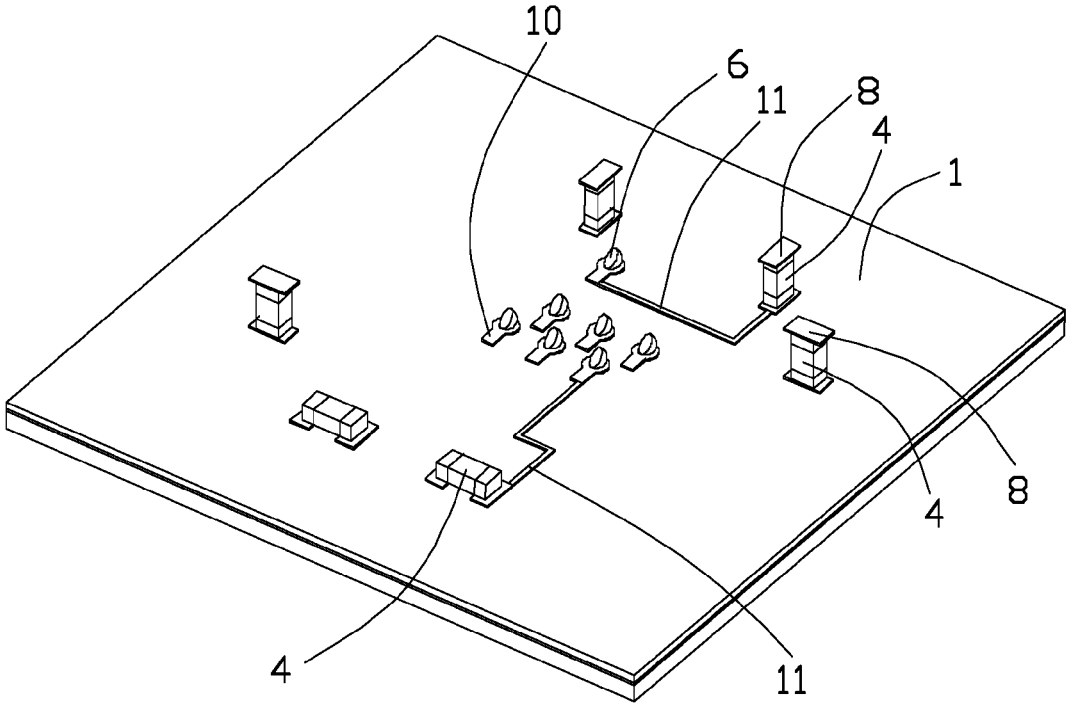
FIG. 5 shows a signal contact connecting with a capacitance in the printed circuit board.

The ground contacts 31 also include receiving portions 310, head portions 311, and tail portions 312. The receiving portions 310 are connected with the shield frame 5 by metallic blocks 7 to make the shield frame 5 grounded by the ground contacts 31. The metallic blocks 7 pass through the walls 21 to engage with the shield frame 5 (not show). Referring to FIG. 3 and FIG. 4, the shield frame 5 connects one end of the second group capacitors 4 via connecting elements 8 and another end of the second group capacitor 4 soldered to the printed circuit board 1 for grounding. The shield frame 5 engaging with the connecting elements 8 can increase shielding effect for increasing the grounding points. Alternately, another end of the second group capacitor 4 is further electrically connected to the corresponding signal contact 30 (not shown) via the corresponding line/trace 11, the corresponding pad 10 and the corresponding solder ball 6 as shown in FIG. 5.

In alternative embodiment, the ground contacts 31 can directly connect with the second group capacitors 4 with a manner like the signal contacts 30 connecting with the first group capacitors 4. By setting the second group capacitor 4 in the path of the transmission of the ground contact 31 can reduce crosstalk of the contacts 3.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing having a plurality of walls forming a plurality of passageways thereof;

a plurality of contacts received in the passageways;

a plurality of capacitors being respectively connected with the corresponding contacts in series; wherein the contacts include signal contacts and ground contact;

further including a shield frame disposed within the walls of the insulative housing.

2. The electrical connector as claimed in claim 1, wherein a part of signal contacts in series connect with the capacitors, respectively.

3. The electrical connector as claimed in claim 1, wherein a part of ground contacts in series connect with the capacitors, respectively.

4. The electrical connector as claimed in claim 1, wherein the passageways disposed on the insulative housing defines a receiving area, and wherein the capacitors are disposed out of the receiving area and covered by the insulative housing.

5. The electrical connector as claimed in claim 1, wherein at least one capacitor has one end engaging with the shield frame and another end engaging with a pad on a printed circuit board for grounding.

6. An electrical connector mounted on a printed circuit board, comprising:

an insulative housing having a plurality of walls formed a plurality of passageways thereof;

a plurality of contacts received in the passageways and soldered upon the printed circuit board, and including signal contacts and ground contacts;

a plurality of capacitors disposed on the printed circuit board, and at least one capacitor in series connecting with a corresponding one of said signal contacts.

7. The electrical connector as claimed in claim 6, wherein the capacitor are divided into first and second groups.

8. The electrical connector as claimed in claim 7, wherein the first group capacitors each has a transmission path formed by one of the signal contacts soldered to the printed circuit board and then connecting with one of the first group capacitors via a line.

9. The electrical connector as claimed in claim 8, further including a shield frame disposed in the walls of the insulative housing.

10. The electrical connector as claimed in claim 9, wherein the second group capacitors each has a transmission path formed by one of the ground contacts connecting with the shielding frame by a metallic block and the shielding frame connecting with one of the second group capacitors by a connecting element.

11. An electrical connector assembly comprising:

a printed circuit board;

an electrical connector mounted upon the printed circuit board, said connector including a metallic shielding/grounding frame with structures in grid;

an insulative housing assembled with the shielding frame to define a plurality of passageways corresponding to said structures in grid;

a plurality of contacts disposed in the corresponding passageways, respectively;

a plurality of capacitors mounted upon the printed circuit board to surround the shielding frame; wherein each of said capacitors defines one end contacting a boundary structure of the shielding frame via a connecting element while the other end contacting, via a trace on the printed circuit board, a corresponding contact transmitting a signal.

12. The electrical connector assembly as claimed in claim 11, wherein each of said contacts is connected to the printed circuit board via a corresponding solder ball.

13. The electrical connector assembly as claimed in claim 11, wherein said capacitors are located under the housing.

* * * * *